US005655649A

United States Patent [19]

Lazzer

[11] Patent Number: 5,655,649

[45] Date of Patent: Aug. 12, 1997

[54] DEVICE FOR CONTROLLING A SWITCH

[75] Inventor: Jean-Pierre Lazzer, Le Creusot, France

[73] Assignee: Robot-Coupe (S.N.C.), France

[21] Appl. No.: 634,603

[22] Filed: Apr. 18, 1996

[30] Foreign Application Priority Data

Apr. 26, 1995 [FR] France ..... 95 04973

[51] Int. Cl.[6] ..... H01H 13/00

[52] U.S. Cl. ..... 200/552; 200/318; 200/323

[58] Field of Search ..... 200/332.2, 332, 200/335, 325, 323, 318, 552, 318.1, 513

[56] References Cited

U.S. PATENT DOCUMENTS 2,034,938 3/1936 Bierenfeld ..... 200/552

2,303,833 12/1942 Furnas et al. ..... 200/552

2,363,852 11/1944 Bierenfeld ..... 200/552

2,921,159 1/1960 Elderton et al. ..... 200/552

3,303,295 2/1967 Davis ..... 200/552

*Primary Examiner*—David J. Walczak

*Attorney, Agent, or Firm*—Eckert Seamans Cherin & Mellott

[57] ABSTRACT

A device controls a switch by means of at least two buttons. The device has at least two buttons acting on levers, each having an end that can bear against the plunger of the switch. The device is particularly applicable to food processors.

5 Claims, 1 Drawing Sheet

DEVICE FOR CONTROLLING A SWITCH

The present invention relates to a device for controlling a multiple-function switch that is particularly, but not exclusively, intended for use in an appliance for processing food, commonly known as a food processor.

BACKGROUND OF THE INVENTION

It is known that by mounting various different tools inside or on a bowl, such appliances enable a large number of functions to be performed. In such appliances, the electrical power supply to the motor is controlled by a switch. Given all of the operating conditions that may apply to such appliances, they are conventionally switched on by means of three buttons, namely an ON button, an OFF button, and a pulse button. The first two buttons enable the appliance to operate continuously or to remain off continuously, while the pulse button keeps the appliance operating only while it is depressed. As soon as pressure is released, the appliance stops.

In present systems, each of the buttons is electrically connected to an electronic circuit card that controls a relay which itself acts on the switch. Operation of the switch requires mechanical action on a plunger. Such an electronic solution is relatively expensive and, in an appliance that is subject to vibration, suffers from the drawbacks of electronic systems.

Another solution consists in associating each button with a switch, with the switches being connected in parallel. That is another expensive solution.

OBJECTS AND SUMMARY OF THE INVENTION

An object of the present invention is to mitigate the above drawback and to propose a mechanical device for controlling a multiple-function switch via three buttons of the above type.

According to the present invention, the device enabling at least two buttons to control a multiple-function switch that includes a plunger, consists in a first part hinged about an axis disposed between two buttons and a second thrust member hinged about an axis, locking means enabling one or the other of the positions of the part or the lever to be locked.

Thus, pressure exerted on any one of the three buttons serves to switch the appliance on or off. A single switch enables all three required functions to be provided.

BRIEF DESCRIPTION OF THE DRAWING

Other characteristics and advantages of the invention appear from the following description of particular embodiments, given purely as non-limiting accompanying drawing, in which.

MORE DETAILED DESCRIPTION

Figure 2:
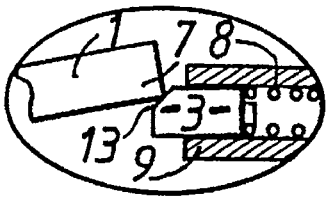
FIG. 2 is a detail view of the connection between the part 1 and the catch 3 in the ON position.
Figure 1:
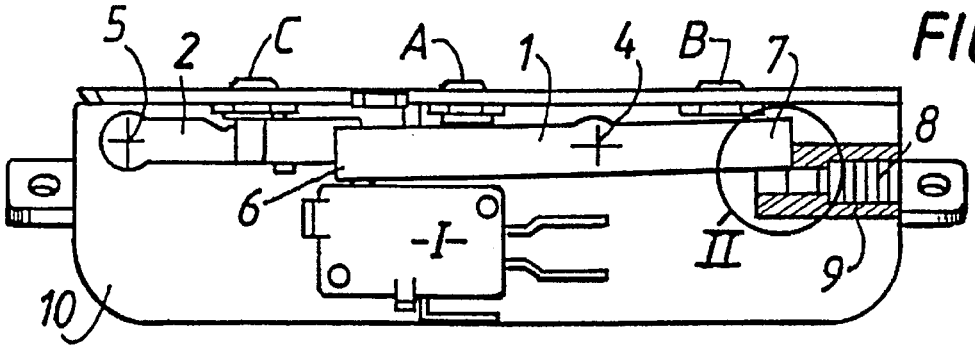
FIGS. 1, 3, and 5 are elevation views of the device respectively in an ON position, an OFF position and a pulse position.
Figure 4:
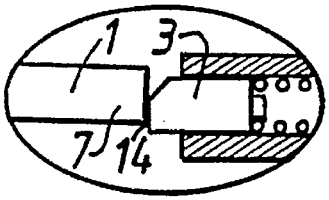
FIG. 4 is a detail view of the same elements in the OFF position.
Figure 3:
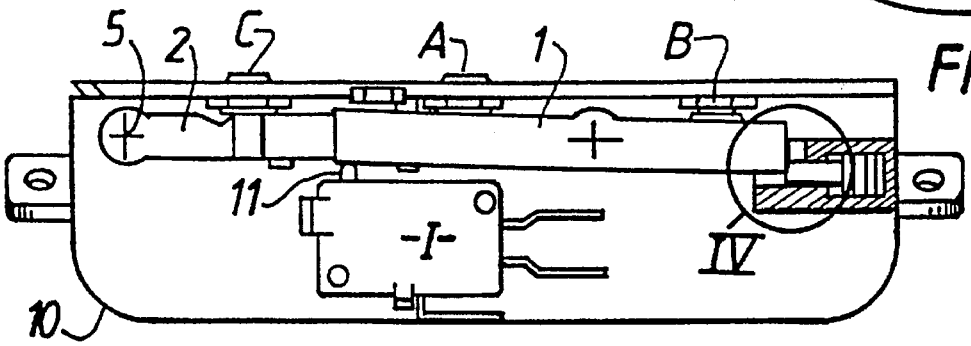
Figure 6:
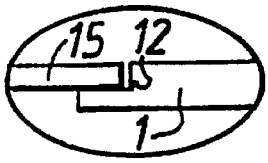
FIG. 6 is a plan view of the organization of the control levers 1 and 2.
Figure 5:
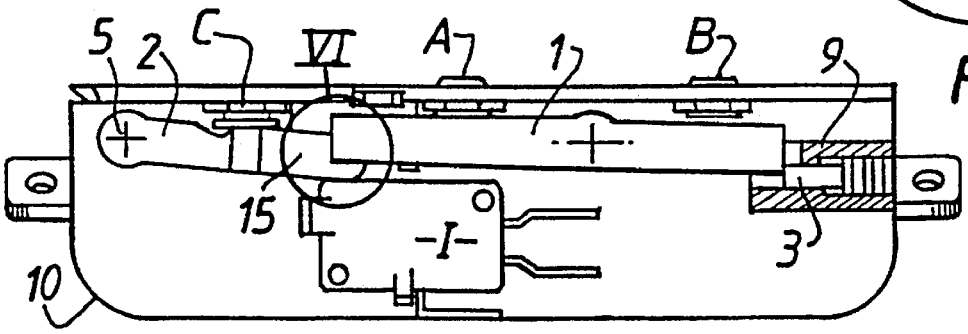

In FIGS. 1, 3, and 5, there can be seen a case 10 containing a switch I of the microswitch type or similar. The switch is connected to an electrical circuit (not shown). A plunger 11 projects from the top portion of the switch I. Depending on whether the plunger projects from or is retracted inside the box of the switch I, the switch is either on or off. Above the switch I there are two levers 1 and 2 each having an end that can bear against the plunger 11. The positions of the levers are controlled by buttons A, B, and C that project to the outside of the case 10. The lever 1 is hinged about an axis 4 that is fixed relative to the case 10 and it rocks like the beam of a balance. FIG. 1 shows the ON position, i.e. the position in which the switch I, conducts electricity. This result is obtained by pressing the button A, which depression tilts the beam 1 counterclockwise so that its end 6 bears against and presses down the plunger 11. The end 7 of the lever 1 is locked by an catch 3 that is movable in a guide 9 under drive from a return spring 8. This locking comes from the fact that the catch 3 has a chamfer 13 formed thereon and the bottom corner of the end 7 bears thereagainst. This position is shown in detail on a larger scale in FIG. 2. In this position the appliance runs continuously until the user presses the OFF button B. At this moment, the beam 1 tilts in the clockwise direction about the axis 4 and takes up the position shown in FIG. 3. Pressing the button B causes the end 7 to slide over the chamfer 13 so that the tip 14 of the catch 3 comes into contact with the bottom edge of the end 7. This sliding compresses the spring 8 and the OFF position is thus suitably locked. It persists until the button A is pressed again, thereby lifting the end 7 of the lever 1 and allowing the catch 3 to move out beneath said end 7. When the lever 1 tilts so as to release the plunger 11, the switch I is switched OFF, i.e. it does not conduct electricity. While the switch is OFF, it is possible to operate the pulse button C. As mentioned above, the button C bears against the lever 2 which is hinged about an axis 5 disposed at one of the ends of the lever 2. As can be seen in FIG. 6, the lever 1 has a setback 12 in which the end 15 of the lever 2 can slide so as to press against the plunger 11 and push it in so as to turn on the switch I. When the button C is released, the spring of the button 11 returns the lever 2 to its horizontal position and the appliance is no longer powered.

Naturally, the buttons may be independent of the levers or they may be molded thereon.

Numerous variants can be provided without going beyond the ambit of the invention, in particular by substituting equivalent technical means.

I claim:

1. A multiple function switching device comprising:

a casing, a switch having a control plunger, said switch being coupled to the casing, first and second buttons movably disposed in the casing, a lever having a first and second end, a slidable catch movably disposed in the casing said slidable catch driven by a return spring, the first button being operable to bear against the first end of the lever, the second button being operable to bear against the second end of the lever, the lever being hinged about a first axis journaled in the casing said first axis being disposed between the first and second buttons, the first end of the lever being operable to bear against the control plunger thereby depressing the control plunger, the second end of the lever bearing against the slidable catch said return spring driving the slidable catch towards the second end of the lever.

2. The device of claim 1 comprising a second lever having a first and second end and a third button movably disposed in the casing said third button being operable to bear against the second lever, wherein the first end of the second lever is hinged about a second axis journaled in the casing, the second end of the second lever being operable to bear against the control plunger thereby depressing the control plunger.

3. The device of claim 2 wherein the first end of the lever is formed with a setback and the second end of the second lever slidably engages the setback.

4. The device of claim 1 wherein the slidable catch has a tip and a chamfer, the lever is pivotable between a first and second position and the control plunger is movable between a depressed and released position, the first end of the lever being operable to bear against the control plunger thereby depressing the control plunger the second end of the lever bearing against the chamfer of the slidable catch when the lever is in the first position, the first end of the lever being operable to move away from the control plunger thereby releasing the control plunger the second end of the lever beating against the tip of the slidable catch when the lever is in the second position.

5. The device of claim 4 wherein the first button is operable to move the lever into the first position and the second button is operable to move the lever into the second position.

* * * * *